US010415498B2

(12) United States Patent
Funk et al.

(10) Patent No.: US 10,415,498 B2
(45) Date of Patent: Sep. 17, 2019

(54) COOLANT OUTLET SYSTEM

(71) Applicant: Progress Rail Locomotive Inc., LaGrange, IL (US)

(72) Inventors: Louis Funk, Homewood, IL (US); Frank Kalemba, Chicago, IL (US); Patricia A. McWade, Willowbrook, IL (US)

(73) Assignee: Progress Rail Locomotive Inc., LaGrange, IL (US)

( * ) Notice: Subject to any disclaimer, the term of this patent is extended or adjusted under 35 U.S.C. 154(b) by 105 days.

(21) Appl. No.: 15/611,847

(22) Filed: Jun. 2, 2017

(65) Prior Publication Data

US 2018/0347506 A1 Dec. 6, 2018

(51) Int. Cl.

| | |
|---|---|
| ***F01P 3/02*** | (2006.01) |
| ***F02F 1/40*** | (2006.01) |
| ***F02F 7/00*** | (2006.01) |
| ***F01P 11/04*** | (2006.01) |
| ***F02B 61/00*** | (2006.01) |

(52) U.S. Cl.

CPC *F02F 1/40* (2013.01); *F01P 3/02* (2013.01); *F01P 11/04* (2013.01); *F02B 61/00* (2013.01); *F02F 7/007* (2013.01); *F01P 2003/024* (2013.01)

(58) Field of Classification Search

CPC ..... F02F 1/40; F02F 7/007; F01P 3/02; F01P 2003/024; F02B 61/00

See application file for complete search history.

(56) References Cited

U.S. PATENT DOCUMENTS

| | | | | |
|---|---|---|---|---|
| 5,195,468 | A | 3/1993 | Clark et al. | |
| 6,377,876 | B1 * | 4/2002 | Hedeen | F01P 5/14 246/1 R |
| 2007/0079776 | A1 * | 4/2007 | Moller | F02F 1/16 123/41.74 |
| 2008/0197209 | A1 * | 8/2008 | Ganzer | B29C 44/3446 239/8 |
| 2011/0220043 | A1 * | 9/2011 | Escriva | F01L 3/22 123/41.72 |

FOREIGN PATENT DOCUMENTS

| | | |
|---|---|---|
| CN | 101413464 | 4/2009 |
| CN | 201407167 | 2/2010 |
| CN | 105221285 | 1/2016 |
| CN | 205154422 | 4/2016 |

* cited by examiner

*Primary Examiner* — Jacob M Amick
*Assistant Examiner* — Charles Brauch
(74) *Attorney, Agent, or Firm* — Jonathan F. Yates

(57) ABSTRACT

A coolant outlet system for a cylinder head associated with an engine includes a core hole communicating with an upper surface thereof, wherein the core hole is in fluid communication with a coolant jacket of the cylinder head. The coolant outlet system includes an outlet tube having a first end and a second end, wherein the first end of the outlet tube is coupled to the core hole. The coolant outlet system also includes a jumper elbow coupled to the second end of the outlet tube, wherein the outlet tube and the jumper elbow provide fluid communication between the coolant jacket and an engine crankcase to introduce coolant discharged from the core hole into the engine crankcase.

20 Claims, 3 Drawing Sheets

COOLANT OUTLET SYSTEM

TECHNICAL FIELD

The present disclosure relates to an engine, and more particularly to a coolant outlet system associated with a cylinder head of the engine.

BACKGROUND

A cylinder head of an Internal Combustion (IC) engine includes a coolant jacket to circulate coolant, containing water, through the cylinder head to facilitate transfer of excess heat away from the cylinder head. Coolant from the cylinder head is generally discharged towards a crankcase through an outlet hole provided in a flange of the cylinder head. The outlet hole is susceptible to failures caused by mechanical fatigue due to a combination of mean and alternating stresses applied to the cylinder head by a crab during initial bolt-up and combustion events, respectively. Once the crack in the outlet hole begins to propagate, coolant can leak out of the cylinder head and cause engine failure due to loss of coolant pressure.

U.S. Pat. No. 5,195,468 describes an outlet end cooling system for a cylinder head of a locomotive engine that includes a modified water pathway in the cylinder head, an outlet therefrom exiting from an upwardly directed surface of the cylinder head, and further including a modified rocker arm support having a planar bottom support surface and having an inlet port therein which is engageable with an outlet port in the cylinder head. The support has a water pathway therein which terminates in a nipple, the nipple extending past the cylinder head and downwardly along a side wall of the cylinder head into engagement with a remaining portion of the waterway. The improved outlet end allows for equal thickness of the side wall around the entire extent thereof, and eliminates a temperature gradient in an area of the cylinder head underlying a crab plate engaged thereover, virtually eliminating cracking and extending the useful life of the cylinder head.

SUMMARY OF THE DISCLOSURE

In one aspect of the present disclosure, a coolant outlet system for a cylinder head associated with an engine is provided. The cylinder head includes a core hole communicating with an upper surface thereof, wherein the core hole is in fluid communication with a coolant jacket of the cylinder head. The coolant outlet system includes an outlet tube having a first end and a second end, wherein the first end of the outlet tube is coupled to the core hole. The coolant outlet system also includes a jumper elbow coupled to the second end of the outlet tube, wherein the outlet tube and the jumper elbow provide fluid communication between the coolant jacket and an engine crankcase to introduce coolant discharged from the core hole into the engine crankcase.

In another aspect of the present disclosure, a cylinder head associated with an engine is provided. The cylinder head includes a core hole communicating with an upper surface thereof. The cylinder head includes a coolant jacket formed within the cylinder head, wherein the core hole is in fluid communication with the coolant jacket. The cylinder head also includes a coolant outlet system in fluid communication with the coolant jacket for discharging coolant from the core hole into an engine crankcase. The coolant outlet system includes an outlet tube having a first end and a second end, wherein the first end of the outlet tube is coupled to the core hole. The coolant outlet system also includes a jumper elbow coupled to the second end of the outlet tube, wherein the outlet tube and the jumper elbow provide fluid communication between the coolant jacket and the engine crankcase.

In yet another aspect of the present disclosure, an engine is provided. The engine includes a cylinder head having a core hole communicating with a recessed surface thereof. The cylinder head also includes a coolant jacket formed within the cylinder head, wherein the core hole is in fluid communication with the coolant jacket. The cylinder head also includes a coolant outlet system in fluid communication with the coolant jacket for allowing an outflow of coolant from the core hole. The coolant outlet system includes an outlet tube having a first end and a second end, wherein the first end of the outlet tube is coupled to the core hole. The coolant outlet system also includes a jumper elbow coupled to the second end of the outlet tube. The engine also includes a crankcase in fluid communication with the coolant jacket via the outlet tube and the jumper elbow. The crankcase is adapted to receive the coolant discharged from the core hole of the cylinder head via the outlet tube and the jumper elbow.

Other features and aspects of this disclosure will be apparent from the following description and the accompanying drawings.

DETAILED DESCRIPTION

Wherever possible, the same reference numbers will be used throughout the drawings to refer to the same or the like parts. Also, corresponding or similar reference numbers will be used throughout the drawings to refer to the same or corresponding parts.

Figure 1:
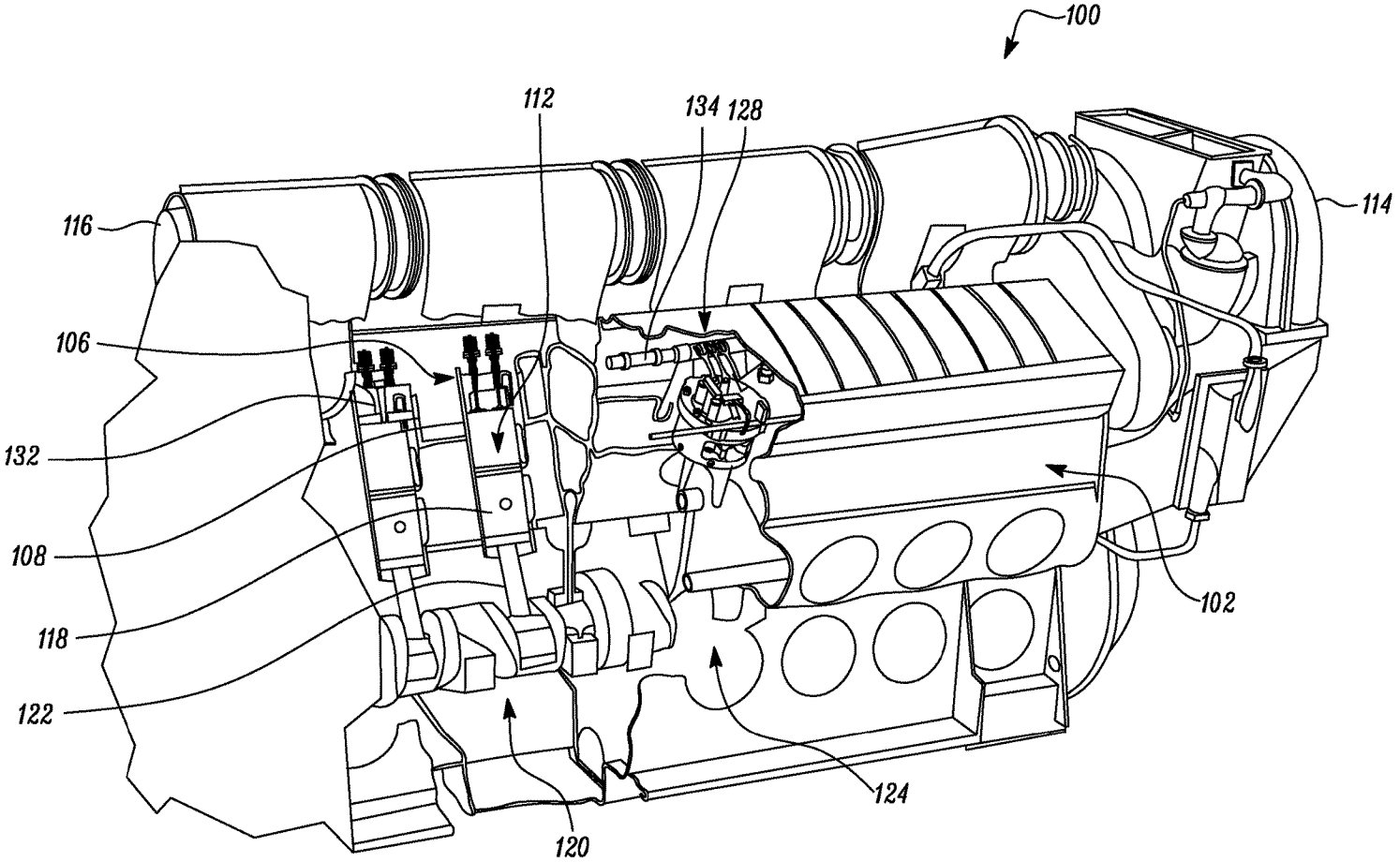
FIG. 1 is a perspective view of an exemplary engine, according to one embodiment of the present disclosure.

FIG. 1 illustrates a perspective view of an engine 100. The engine 100 is embodied as an internal combustion engine, and more particularly a reciprocating piston engine. Further, the engine 100 may include any one of a spark ignition engine or a compression ignition engine, such as a diesel engine, a natural gas engine, a homogeneous charge compression ignition engine, a reactivity controlled compression ignition engine, or any other engine known in the art. The engine 100 may be fueled by one or a combination of gasoline, diesel fuel, biodiesel, dimethyl ether, alcohol, natural gas, propane, or any other combustion fuel known in the art.

It should be recognized that the concepts of the present disclosure may be suitably applicable to any type and configuration of the engine 100. The engine 100 may be used to power a machine including, but not limited to, an on-highway truck, an off-highway truck, a loading machine, an earth moving machine, a locomotive, and an electric generator. In the illustrated embodiment, the engine 100 is associated with a locomotive (not shown). Further, the engine 100 may be associated with an industry including, but not limited to, transportation, construction, agriculture, forestry, power generation, marine, mining, and material handling.

The engine 100 includes an engine block 102. The engine block 102 includes a number of cylinders 106 defined therein, some of which are shown in the accompanying figure. The cylinders 106 may be arranged in any configuration such as inline, radial, "V", and so on. The engine 100 of the illustrated embodiment is a V-type engine. It should be noted that a number of cylinders 106 associated with the engine 100 may vary. Accordingly, the engine 100 may include 8 cylinders, 12 cylinders, 16 cylinders, or 20 cylinders, based on system requirements. A cylinder liner 108 may be disposed within each cylinder 106, and a cylinder head 110 closes off an end of the cylinder liner 108.

Further, a combustion chamber 112 is formed within each cylinder 106 of the engine 100. The combustion chamber 112 may receive intake air from the intake manifold (not shown). The engine 100 includes a turbocharger 114 that increases an efficiency and power output of the engine 100 by forcing extra air into the combustion chamber 112 of the engine 100. Further, products of combustion created during combustion within the combustion chamber 112 are let out of the engine 100, via an exhaust manifold 116.

The engine 100 further includes a piston 118 movably disposed within each of the cylinders 106. Each of the pistons 118 may be coupled to a crankshaft 120 of the engine 100, via a connecting rod 122. Energy generated from combustion of fuel inside the cylinders 106 may be converted to rotational energy of the crankshaft 120 by the pistons 118. The crankshaft 120 is mounted within a crankcase 124 of the engine 100. Additionally, the engine 100 may include various other components and/or systems (not shown) such as, a fuel system, an air intake system, an exhaust gas recirculation system, an aftertreatment system, and so on.

The engine 100 also includes a cooling system. The cooling system is adapted to remove waste heat from the engine 100 and maintain various engine components at allowable operating temperatures. The engine 100 may be an air-cooled engine or a liquid-cooled engine. The engine 100 illustrated herein is a liquid-cooled engine.

Figure 2:
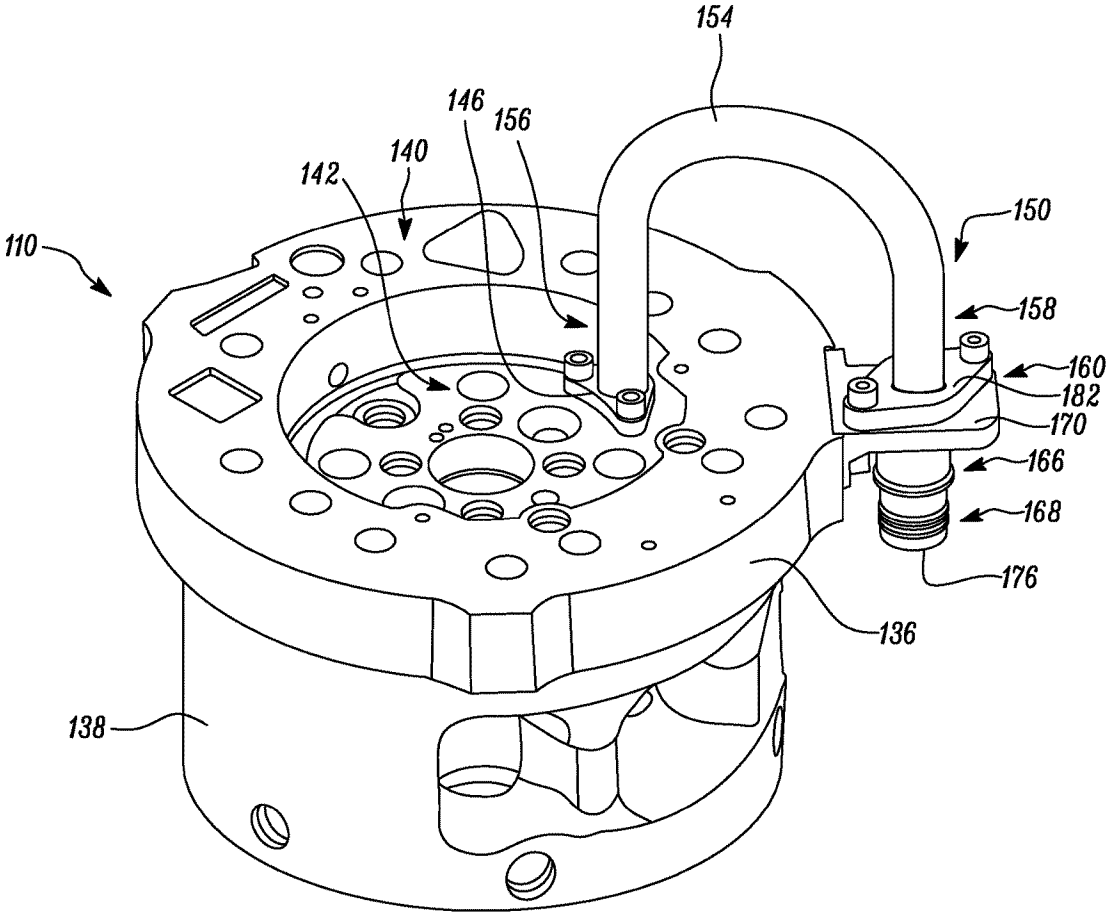
FIG. 2 is a perspective view of a cylinder head associated with the engine of FIG. 1 having a coolant outlet system, according to one embodiment of the present disclosure.

Further, each cylinder 106 includes the cylinder head 110 (shown in FIG. 2). The cylinder head 110 houses one or more components and/or systems of the engine 100 such as rocker arms 128, an intake valve (not shown), an exhaust valve (not shown), a fuel injector 132, and so on. A camshaft 134 running along a length of the number of cylinders 106 is used to operate the intake and exhaust valves of the engine 100, via the rocker arms 128. Further, a crab plate (not shown) is used to hold the cylinder head 110 in place within the engine 100. It should be noted that the cylinder head 110, the pistons 118, the cylinder liners 108, and the connecting rods 122 are components of a power assembly of the engine 100.

Figure 3:
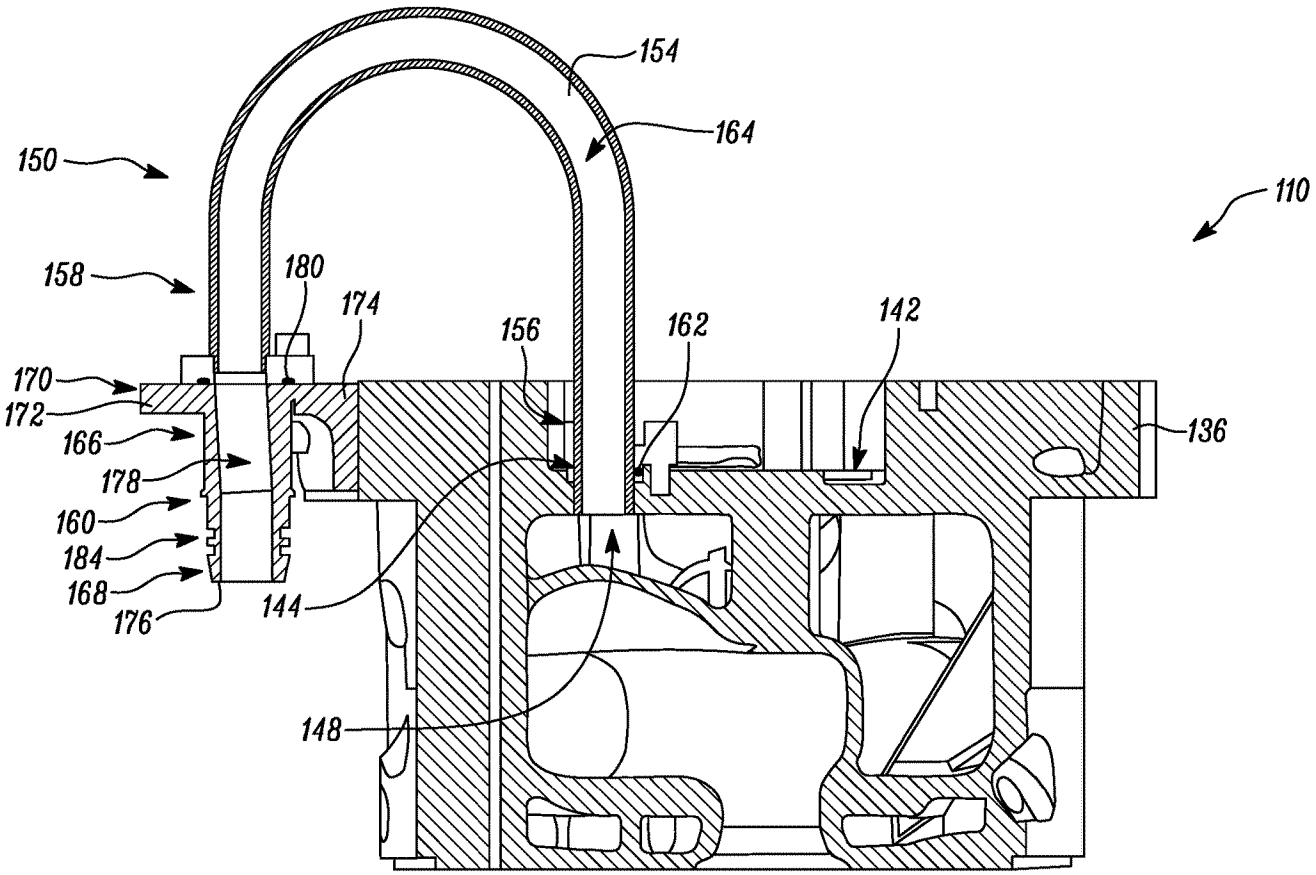
FIG. 3 is a cross-sectional view of the cylinder head having the coolant outlet system.

FIG. 2 illustrates a perspective view of the cylinder head 10. The cylinder head 110 includes a flange 136 and a generally cylindrical body 138 that defines an upper surface 140. Further, the upper surface 140 defines a recessed and non-peripheral surface 142 of the cylinder head 110. The recessed and non-peripheral surface 142 includes one or more core holes that are used in a sand casting process to orient and support sand cores. One such core hole 144 is shown in FIG. 3. In one example, the recessed and non-peripheral surface 142 of the cylinder head 110 includes seven core holes. However, a number of the core holes may vary, without any limitations. Referring to FIG. 3, the core hole 144 is in communication with the upper surface 140, and more particularly, with the recessed and non-peripheral surface 142 of the cylinder head 110.

The cylinder head 110 includes a coolant jacket 148. The coolant jacket 148 includes a number of passages that are in fluid communication with an engine radiator (not shown) to allow passage of coolant therethrough. The coolant jacket 148 and the engine radiator form a part of the cooling system of the engine 100. In the illustrated embodiment, the coolant contains water. More particularly, the coolant may include any engine coolant containing a mixture of water and chemicals, such as antifreeze and rust inhibitors, without any limitations.

Referring now to FIGS. 2 and 3, the cylinder head 110 includes a coolant outlet system 150. The coolant outlet system 150 provides fluid communication between the coolant jacket 148 and the crankcase 124 (see FIG. 1). More particularly, the coolant outlet system 150 allows an outflow of the coolant from the coolant jacket 148 of the cylinder head 110 in order to introduce the discharged coolant into the crankcase 124. In the illustrated embodiment, the coolant is discharged from the core hole 144 of the cylinder head 110 and is introduced into the crankcase 124 by the coolant outlet system 150. The coolant is discharged through the core hole 144 because the core hole 144 is proximal to an aperture (not shown) defined in the crankcase 124. The aperture in the crankcase 124 provides fluid communication between the coolant outlet system 150 and a coolant manifold (not shown) of the crankcase 124. The core hole 144 is in fluid communication with the coolant jacket 148. It should be understood that the coolant can be transferred via any other core hole in the recessed and non-peripheral surface 142, without any limitations.

The coolant outlet system 150 includes an outlet tube 154. The outlet tube 154 includes a first end 156 and a second end 158. The first end 156 is coupled to the core hole 144. A first connecting member 146 (shown in FIG. 2) couples the first end 156 of the outlet tube 154 with the core hole 144. Further, the outlet tube 154 is in fluid communication with the coolant jacket 148 via the core hole 144. More particularly, the outlet tube 154 defines a passageway 164 (shown in FIG. 3) that is in fluid communication with the passages of the coolant jacket 148, via the core hole 144. A diameter of the outlet tube 154 corresponds to a diameter of the core hole 144. Further, a second end 158 of the outlet tube 154 is coupled to a jumper elbow 160.

The outlet tube 154 may be made of a ridged material, a flexible material, or a combination thereof. For example, the outlet tube 154 may be made of ridged materials, such as, steel or copper. Alternatively, the outlet tube 154 may be made of a flexible material, such as, rubber and may embody a rubber hose, without any limitations. In the illustrated example, the outlet tube 154 includes an inverted U-shape, without any limitations. Further, the outlet tube 154 may embody a single unitary component. Alternatively, the outlet tube 154 may include multiple tubes of smaller length that are assembled to form the outlet tube 154.

The outlet tube 154 includes a first sealing member 162 (shown in FIG. 3). The first sealing member 162 encapsulates the coolant being transferred between the recessed and non-peripheral surface 142 and the outlet tube 154. The first scaling member 162 may include any one of a bore seal, face seal, flared tube seal, or chamfer O-ring seal, O-ring boss seal, national pipe thread seal, or other threaded seal, and Victaulic® or clamp seal, without any limitations.

The coolant outlet system 150 also includes the jumper elbow 160. The jumper elbow 160 is coupled to a peripheral surface of the flange 136. The jumper elbow 160 is mechanically coupled to the cylinder head 110 such that the jumper elbow 160 acts as a locating device to orient the power assembly in the crankcase 124. A first end 166 of the jumper elbow 160 is coupled to the outlet tube 154 such that the outlet tube 154 is in fluid communication with the jumper elbow 160. A second connecting member 182 (shown in FIG. 2) couples the second end 158 of the outlet tube 154 with the first end 166 of the jumper elbow 160. Further, a second end 168 of the jumper elbow 160 is coupled to the crankcase 124 (see FIG. 1). The jumper elbow 160 provides fluid communication between the outlet tube 154 and the crankcase 124. Thus, the outlet tube 154 and the jumper elbow 160 provide fluid communication between the coolant jacket 148 and the crankcase 124 to introduce the coolant discharged from the core hole 144 into the crankcase 124.

In one example, the jumper elbow 160 is coupled to the flange 136 of the cylinder head 110 at a location that is proximal to a location of the core hole 144 to incorporate an outlet tube 154 of a small length. The jumper elbow 160 includes a bracket 170 that allows coupling of the jumper elbow 160 to the flange 136 of the cylinder head 110. Referring to FIG. 3, the bracket 170 is L-shaped; however a shape of the bracket 170 may vary, without any limitations. The bracket 170 includes a first plate 172 that extends horizontally from the flange 136 when the bracket 170 is coupled to the flange 136. Further, a second plate 174 of the bracket 170 allows coupling of the jumper elbow 160 to the flange 136 of the cylinder head 110. The second plate 174 can be coupled to the flange 136 using mechanical fasteners, such as, bolts, rivets, pins, and the like. In other examples, the second plate 174 can be coupled to the flange 136 using adhesives or a joining process, such as, welding, brazing, soldering, and the like, without any limitations.

The jumper elbow 160 also includes an elbow piece 176. A diameter of the elbow piece 176 corresponds to the diameter of the outlet tube 154. The elbow piece 176 includes a passageway 178 that is in fluid communication with the passageway 164 of the outlet tube 154. The jumper elbow 160 may embody a unitary component such that the elbow piece 176 is integrally formed with the bracket 170. In such an example, the jumper elbow 160 may embody a cast metal piece. Alternatively, the jumper elbow 160 may be made using any other manufacturing process, such as, molding, 3D printing, and the like, without limiting the scope of the present disclosure.

In another example, the bracket 170 and the elbow piece 176 may be manufactured as separate components that are assembled to form the jumper elbow 160. In such an example, the elbow piece 176 may be threadably coupled with the bracket 170. Alternatively, the elbow piece 176 may be coupled to the bracket 170 using mechanical fasteners or by a joining process, such as welding, brazing, soldering, or using adhesives, without any limitations.

The jumper elbow 160 includes a second sealing member 180. The second sealing member 180 encapsulates the coolant being transferred between the outlet tube 154 and the jumper elbow 160. Further, a third sealing member 184 encapsulates the coolant that is transferred between the jumper elbow 160 and the crankcase 124. The second sealing member 180 and the third sealing member 184 may include any one of a bore seal, face seal, flared tube seal, or chamfer O-ring seal, O-ring boss seal, national pipe thread seal, or other threaded seal, and Victaulic® or clamp seal, without any limitations.

INDUSTRIAL APPLICABILITY

The present disclosure relates to the coolant outlet system 150 associated with the cylinder head 110. The components of the coolant outlet system 150 are simple to design and manufacture, and are cost effective. Also, the cylinder head 110 does not require any design modifications to incorporate the coolant outlet system 150. According to the teachings of the present disclosure, the coolant is discharged from the core hole 144 in the recessed and non-peripheral surface 142 of the cylinder head 110, thereby eliminating requirement of a separate outlet hole in the flange 136 for discharging the coolant. As the outlet hole in the flange 136 is susceptible to failures, eliminating the outlet hole in turn reduces engine down time caused by the failure of the outlet hole. Further, drilling and burnishing operations for provision of the outlet hole is also eliminated.

The coolant outlet system design operates in an allowable footprint of the recessed and non-peripheral surface 142 of the cylinder head 110 to restrict any interference of the coolant outlet system 150 with valve operations. Further, the jumper elbow 160 of the coolant outlet system 150 is coupled to the cylinder head 110 in a manner that allows for a correct orientation of the power assembly and other engine components during assembly of the engine 100. The coolant outlet system 150 is a stand-alone system that is not integrated with any other components/systems of the engine 100 which simplifies replacement and servicing procedures if any engine system fails.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

The invention claimed is:

1. A coolant outlet system for a cylinder head associated with an engine, wherein the cylinder head includes a core hole communicating with an upper surface thereof and a flange extending circumferentially around the upper surface, wherein the cylinder head defines a vertical axis and the core hole is in fluid communication with a coolant jacket of the cylinder head, the coolant outlet system comprising:

an outlet tube having a first end and a second end, wherein the first end of the outlet tube is coupled to the core hole and the outlet tube extends up and over the flange outside of the cylinder head from the first end to the second end; and a jumper elbow coupled to the second end of the outlet tube, wherein the outlet tube and the jumper elbow provide fluid communication between the coolant jacket and an engine crankcase to introduce coolant discharged from the core hole into the engine crankcase.

2. The coolant outlet system of claim 1, wherein the upper surface includes a recessed and non-peripheral surface of the cylinder head.

3. The coolant outlet system of claim 2 further comprising a sealing member to encapsulate the coolant being transferred between the recessed and non-peripheral surface and the jumper elbow.

4. The coolant outlet system of claim 1, wherein the outlet tube includes at least one of a rigid material, a flexible material, and a combination thereof.

5. The coolant outlet system of claim 1, wherein the jumper elbow is embodied as a unitary component coupled to the flange of the cylinder head.

6. The coolant outlet system of claim 1, wherein the jumper elbow includes a bracket and an elbow piece, wherein the bracket is coupled to the flange of the cylinder head and the elbow piece is coupled to the bracket.

7. The coolant outlet system of claim 1, wherein the cylinder head is associated with a locomotive engine.

8. The coolant outlet system of claim 1, wherein the jumper elbow is mechanically coupled to the cylinder head such that the jumper elbow acts as a locating device to orient a power assembly of the engine in the crankcase.

9. A cylinder head associated with an engine, the cylinder head comprising:

an upper surface;

a core hole communicating with the upper surface;

a coolant jacket formed within the cylinder head, wherein the core hole is in fluid communication with the coolant jacket; and a coolant outlet system in fluid communication with the coolant jacket for discharging coolant from the core hole into an engine crankcase, the coolant outlet system comprising:

an outlet tube having a first end and a second end, wherein the first end of the outlet tube is coupled to the core hole, and the second end is positioned peripherally outward of the cylinder head;

a bracket supporting the outlet tube outside of the cylinder head; and a jumper elbow coupled to the second end of the outlet tube, wherein the outlet tube and the jumper elbow provide fluid communication between the coolant jacket and the engine crankcase.

10. The cylinder head of claim 9, wherein the upper surface includes a recessed and non-peripheral surface of the cylinder head.

11. The cylinder head of claim 10 further comprising a sealing member to encapsulate the coolant being transferred between the recessed surface and the jumper elbow.

12. The cylinder head of claim 9, wherein the outlet tube includes at least one of a rigid material, a flexible material, and a combination thereof.

13. The cylinder head of claim 9, wherein the jumper elbow is embodied as a unitary component coupled to a flange of the cylinder head.

14. The cylinder head of claim 9, wherein the jumper elbow includes an elbow piece, wherein the bracket is coupled to a flange of the cylinder head and the elbow piece is coupled to the bracket.

15. The cylinder head of claim 9, wherein the cylinder head is associated with a locomotive engine.

16. An engine comprising:

a cylinder head including a core hole communicating with a recessed surface thereof, the cylinder head further comprising:

a coolant jacket formed within the cylinder head, wherein the core hole is in fluid communication with the coolant jacket;

a flange extending around the recessed surface; and a coolant outlet system in fluid communication with the coolant jacket for allowing an outflow of coolant from the core hole, the coolant outlet system comprising:

an outlet tube having a first end and a second end, wherein the first end of the outlet tube is coupled to the core hole at a location peripherally inward of the flange and the second end is positioned peripherally outward of the flange, and the outlet tube is outside of the cylinder head; and a jumper elbow coupled to the second end of the outlet tube; and a crankcase in fluid communication with the coolant jacket via the outlet tube and the jumper elbow, wherein the crankcase is adapted to receive the coolant discharged from the core hole of the cylinder head via the outlet tube and the jumper elbow.

17. The engine of claim 16 further comprising a sealing member to encapsulate the coolant being transferred between the recessed surface and the jumper elbow.

18. The engine of claim 16, wherein the outlet tube includes at least one of a rigid material, a flexible material, and a combination thereof.

19. The engine of claim 16, wherein the jumper elbow is embodied as a unitary component coupled to a flange of the cylinder head.

20. The engine of claim 16, wherein the jumper elbow includes a bracket and an elbow piece, and wherein the bracket is coupled to the flange of the cylinder head and the elbow piece is coupled to the bracket.

* * * * *